US005890797A

United States Patent [19]

Bish

[11] Patent Number: 5,890,797

[45] Date of Patent: Apr. 6, 1999

[54] MULTI-DIRECTIONAL SECURITY LIGHT WITH ELONGATED EXTENSION ARM

[76] Inventor: Danny R. Bish, 11534 Five Cedars Rd., Charlotte, N.C. 28226

[21] Appl. No.: 882,975

[22] Filed: Jun. 26, 1997

[51] Int. Cl.[6] ..... F21M 3/02

[52] U.S. Cl. ..... 362/419; 362/226; 362/276

[58] Field of Search ..... 362/226, 253, 362/102, 276, 802, 419, 429

[56] References Cited

U.S. PATENT DOCUMENTS

| | | | |
|---|---|---|---|
| 5,381,323 | 1/1995 | Osteen et al. | 362/276 |
| 5,486,987 | 1/1996 | Fritz, Jr. | 362/226 |
| 5,638,339 | 6/1997 | DeLoretto et al. | 362/226 X |

*Primary Examiner*—Stephen Husar
*Attorney, Agent, or Firm*—Dorothy S. Morse

[57] ABSTRACT

A multi-directional, bendable light extension device for use with exterior floodlight fixtures which comprises a first extension arm that can be bent into a plurality of orientations and retains a given orientation without change until it is reconfigured, as well as a lamp housing connected to one end of the first extension arm, the other end of the first extension arm being configured for threaded connection to the standard size of light socket commonly used in commercial and residential construction for exterior lighting purposes. The device further comprises a bendable second extension arm that also holds a given orientation without change until it is reconfigured, the second extension arm being detachably connected on one it its ends to the lamp housing with its other end being connected to a secondary housing having a motion detector sensor, a light sensor, and an audible alarm. Individual activator/disabler switches permit selective use of the motion detector sensor, the light sensor, and the audible alarm for special needs. Applications may include, but are not limited to, use by homeowners to provide more versatile and precise direction of exterior lighting and motion detection apparatus for enhanced security of their premises.

9 Claims, 4 Drawing Sheets

MULTI-DIRECTIONAL SECURITY LIGHT WITH ELONGATED EXTENSION ARM

BACKGROUND

1. Field of Invention

This invention relates to lighting fixtures, specifically to a multi-directional, bendable light extension device for use with exterior floodlight fixtures which comprises a first extension arm that can be bent into a plurality of orientations and retains a given orientation without change until it is reconfigured, a lamp housing connected to one end of the first extension arm, the other end of the first extension arm being configured for threaded connection to the standard size of light socket commonly used in commercial and residential construction for exterior lighting purposes, and which further comprises a second bendable extension arm that holds a given orientation without change until it is reconfigured, the second extension arm being detachably connected on one it its ends to the lamp housing with its other end being connected to a secondary housing containing a motion detector sensor, a light sensor, and an audible alarm. Applications may include, but are not limited to, use by homeowners to provide more versatile and precisely directed exterior lighting and motion detection apparatus for enhanced security of their premises.

2. Description of Prior Art

Rising crime rates have prompted homeowners to become increasingly aware of home security. As a result, growing numbers of homeowners have installed outdoor lighting with motion detector sensors attached thereto that automatically turn on spotlights when movement within a targeted area is encountered. However, the designs of many buildings contain features, such gutter down spouts, which limit the amount of directional aiming possible for prior art spotlights and motion detectors positioned close thereto. Thus, homeowners may be required to accept less than the desired amount of security coverage for areas immediately surrounding their residence. Should the motion detectors be adjusted to target an expanded area around the home in attempts to gain an a desired level of lighting coverage, the homeowners run the risk of unnecessary activation of the spotlights by passing neighborhood animals and motor vehicles. Unnecessary activation can cause undue alarm to occupants of a building, but it can also become a nuisance when it dilutes the effectiveness of its ability to warning building occupants of possible danger. In limiting the targeted area of the motion detectors to reduce unnecessary activation, the homeowners again run the risk excessive limitation beyond the point where the premises are effectively secured. Consequently, due to the limited mobility and extension of currently available exterior lighting fixtures and motion detection sensors, many homeowners presently have exterior lighting which is either excessively activated, or is insufficiently positioned to provide the level of security for which it was intended.

Generally, lighting fixtures with elongated adjustable support arms are known. A variety of desk lamps have base members which can be positioned near to the edge of the desk top and which are connected to elongated support arms that can position a light source over the central portion of a desk, the base member remaining in an out-of-the-way position to maximize the amount of working space available on the desk top surface. Also exterior lighting fixtures are currently available which comprise motion detectors to activate spotlights when movement within a targeted area is detected. However, it is not known, and it would be useful to have, a device comprising exterior lighting and motion detecting units each suspended on an elongated bendable component which would permit nearly unlimited directional orientation thereof, including positioning of light and motion detecting sensors around corners and around gutter down spouts, to provide more precisely directed, and thereby more complete, lighting coverage in the immediate area of a building to minimize its desirability as a target of crime.

The prior art believed to be most closely related to the present invention is the invention disclosed in U.S. Pat. No. 5,381,323 to Osteen (1995) which comprises a proximity sensor remotely positioned from a lampholder so that the heat build-up from the lamp does not prematurely cause the sensor to fail. The Osteen invention comprises a base member which can be attached to a solid surface and provides electrical connections for the lamp; a lampholder for receiving at least one lamp; attachment means for connecting the lampholder to the base member and which permits manual positioning of the lampholder in different positions relative to the base; an adjustable mast arm also attached to the base member and positioned with its distal end remotely located from the lampholder; and a sensor housing attached to the distal end of the mast arm. Movement of the Osteen mast arm is accomplished by two pivot joints and a swivel joint connected between the two pivot joints. In contrast, the present invention has its lamp housing mounted on the end of a first elongated bendable extension arm for more versatile positioning of its light source than is possible with the Osteen invention. The present invention also has threaded connection means on the end of the first extension arm remote from the lamp housing connection for quick and easy use of the present invention with the sockets of existing spotlight fixtures. Further, the present invention has a secondary housing attached to the lamp housing and electrically connected thereto through a second extension arm. The bendable extension arms attached to each allow both the lamp housing and the secondary housing to be oriented into almost any position required for effective security in a targeted area, including use around restrictive design features of a building such as gutter down spouts. Thus more complete lighting coverage can be provided by the present invention without a need for setting a motion detector to scan an expanded target area that in turn causes unnecessary activation of its light and/or alarm to the point where it becomes a distraction or a nuisance. Activator/disabler switches are also provided for the lamp housing, the motion detecting sensor, the light sensor, and the audible alarm to permit varying combinations of use among such components to satisfy differing use requirements. It is not known in the field of lighting fixtures to have a multi-directional, bendable light extension device for attachment to existing exterior lighting fixtures which comprises a first extension arm that can be bent into an unlimited variety of orientations and which retains a given orientation without change until it is reconfigured, a lamp housing connected to one end of the first extension arm, the other end of the first extension arm being configured for threaded connection to the standard size of light socket commonly used in commercial and residential construction, and which further comprises at least one additional bendable extension arm that also holds a given orientation without change until it is reconfigured, the second extension arm being detachably connected on one of its ends to the lamp housing with its other end being connected to a secondary housing having a motion detector, a light sensor, and an audible alarm to provide a virtually unlimited number of positions into which the spotlight and motion detection sensors connected thereto can be placed for more thorough security coverage in and around buildings than is possible with prior art security devices, with a concomitant minimization of unnecessary activation.

SUMMARY OF INVENTION—OBJECTS AND ADVANTAGES

It is the primary object of this invention to provide a multi-directional exterior security lighting device for homeowners with extension arms that can be used to precisely aim spotlights and motion detectors around building design features such as gutter down spouts for enhanced security coverage of buildings and their immediate surroundings without unnecessary activation of security lights and audible alarms. It is also an object of this invention to provide a multi-directional security lighting unit that has a threaded connection on one of its ends configured for electrical connection with the type of light socket commonly used in commercial and residential construction for exterior lighting purposes so that the present invention can be easily connected to an existing light fixture. A further object of this invention is to provide a multi-directional security lighting unit that is made of weatherproof materials for reliable and enduring use. It is also an object of this invention to provide a multi-directional security lighting unit that is made of cost effective materials to allow its widespread use by homeowners. It is also an object of this invention, since the person installing it will usually be positioned on a ladder or other elevated platform, to provide a multi-directional security lighting unit that is light in weight so as to be easy to install and remove.

As described herein, properly manufactured and used, the preferred embodiment of the present invention would provide a security lighting unit which can be easily installed into the standard type of light socket currently used in commercial and residential construction for exterior lighting purposes. It would be made from lightweight materials for easily handling. It would also comprise a spotlight attached to one end of a bendable extension arm so that the spotlight could be conveniently directed around design features on a building, such as gutter down spouts, which would otherwise prevent sufficient lighting coverage in the immediate area surrounding the building. A second bendable extension arm would removably attach a secondary housing to the flood light housing. It is contemplated for the secondary housing to contain objects such a motion detection sensor to activate the attached spotlight when movement is detected within a targeted area, a light sensor to make the attached spotlight inactive during daylight hours, and an audible alarm for alternative or additional security warning. Each object would be connected to an activator/disabler switch that would allow any combination of motion detection sensor, light sensor, and audible alarm to be usable at a given time. Should a user need the spotlight to be continuously activated for a short period of time for a special use, the motion detector could be easily disengaged. Also, when needed, the spotlight or the light sensor could be independently disengaged for special needs while the audible alarm remains active to sound when the motion detector senses movement within a targeted area. It is further contemplated for the audible alarm to be adjustable in volume. Also, the present invention could have a support member which would attach the first extension arm directly to an alternating current supply instead of connection through an existing lighting fixture, or a third extension arm and attached housing, similar to the second, connected to the lamp housing and oriented in a position opposed to second extension arm so that one existing lighting fixture can be used to detect motion coming from more than one direction. Further, in the preferred embodiment the outside surfaces of the lamp housing, the secondary housings, and the extension arms would be made of weatherproof materials, even though it is within the contemplation of the present invention to be made available for interior security use, such as in a garage, a basement, a remote storage room or building, or an upstairs portion of a building not frequently used.

The description herein provides preferred embodiments of the present invention but should not be construed as limiting the scope of the bendable security lighting unit invention. For example, variations in the lengths and diameters of the flexible extension arms, the number of extension arms and secondary housings used, the size of the secondary housings, the type of material used for the outer covering of the extension arms, the type of easily detachable connection means used between each second extension arm and the lamp housing, the type of audible alarm provided, and the means for adjusting the volume of the audible alarm, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
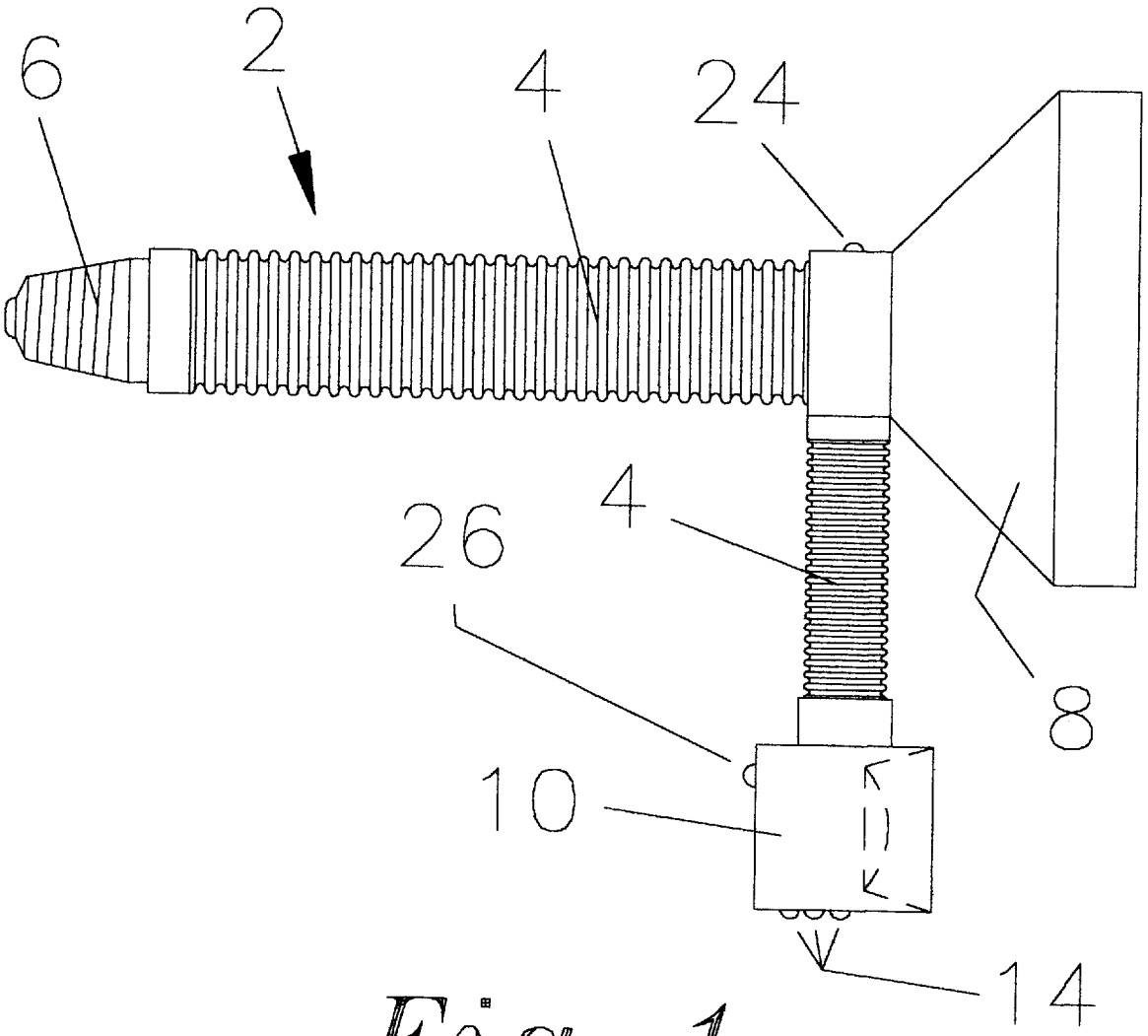
FIG. 1 is a side view of the invention having a lamp housing with two bendable extension arms connected thereto and a secondary housing attached to the lamp housing by one of the extension arms.

FIG. 1 shows a preferred embodiment of a security light extension device 2 having a bendable first extension arm 4, a lamp housing 8 connected to one end of first extension arm 4, and the other end of first extension arm 4 having a threaded configuration comprising the form of a male adapter 6 sized for insertion into the standard type of light socket commonly used in commercial and residential construction for external lighting purposes. Although the use of male adapter 6 is not critical to the present invention, male adapter 6 allows the present invention to be quickly placed into existing light sockets without the delay of having to provide a new source of electrical connection. In the alternative, although not shown, it is contemplated for the present invention to comprise a wall-mounted support member which would connect first extension arm 4 to a remote power source (not shown). The dimension and configuration of such a support member would not be critical to the present invention as long as it would be adequate in size to securely support the weight of lamp housing 8, extension arms 4, and secondary housing 10 and provide a waterproof means of electrical connection for the present invention to the remote power source. The length and diameter of first extension arm 4 and the configuration and dimension of lamp housing 8 are also not critical to the present invention.

Figure 2:
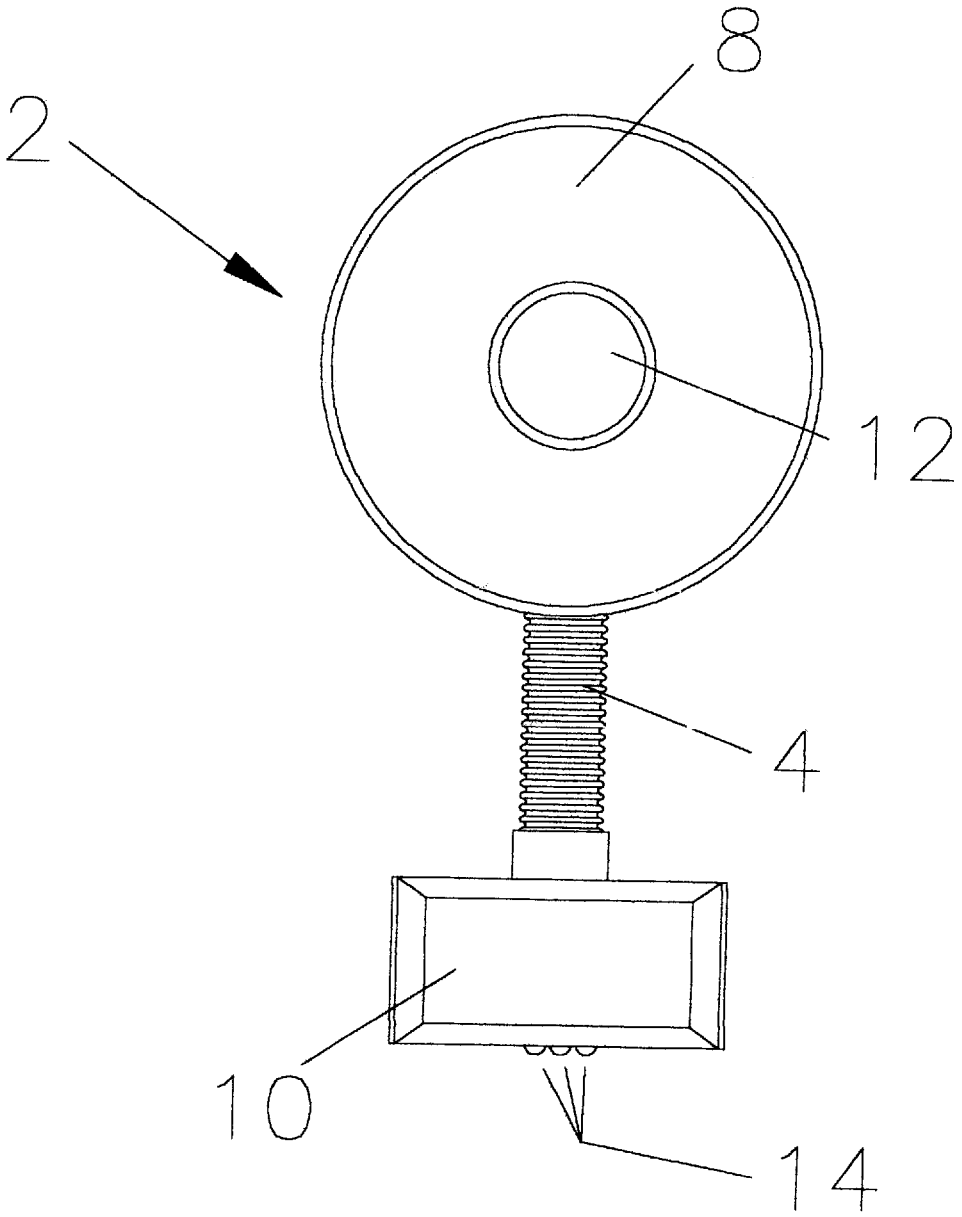
FIG. 2 is a front view of the invention having a secondary housing attached to the lamp housing by an extension arm and activator/disabler switches attached through the bottom of the secondary housing.
Figure 3:
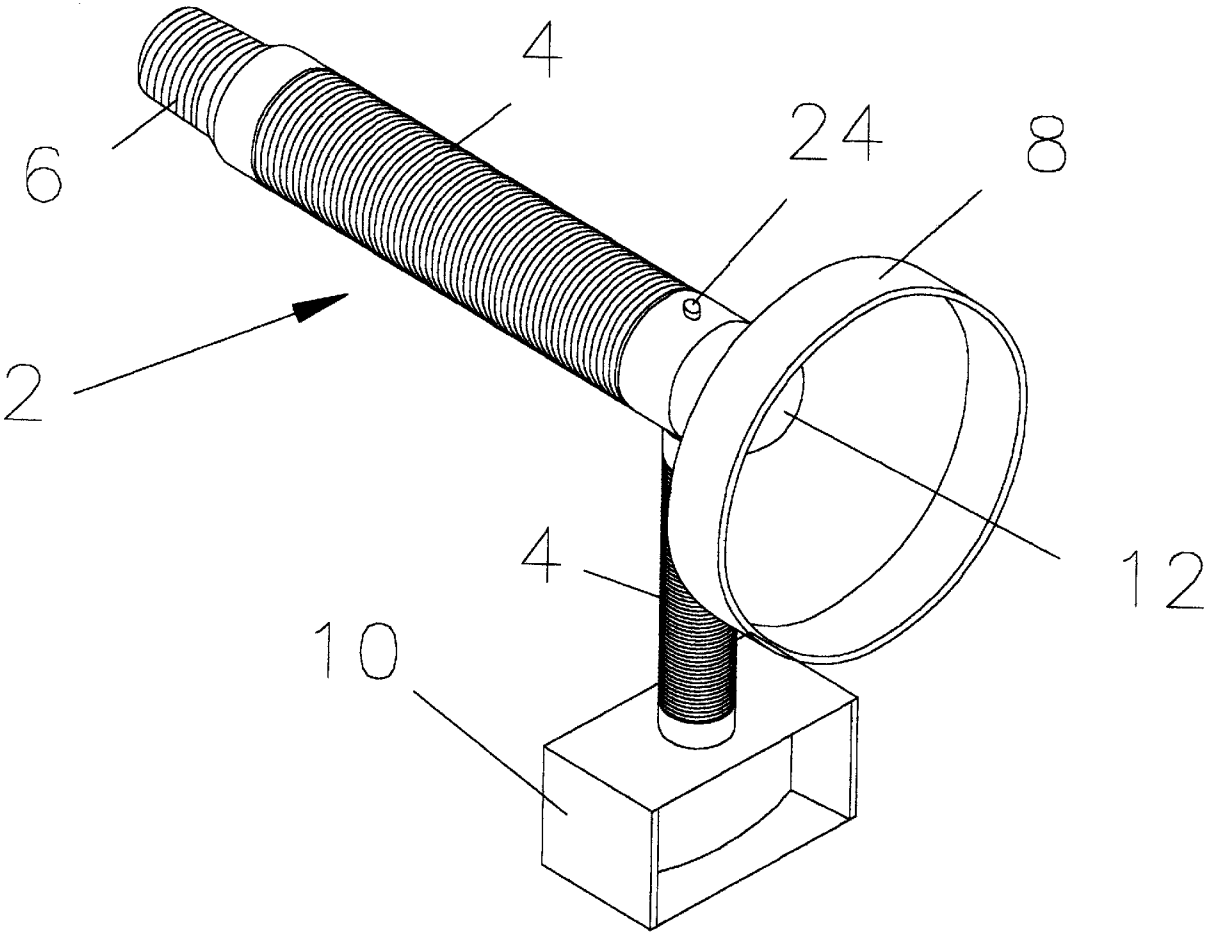
FIG. 3 is a perspective view of the invention.

FIG. 1 further shows lamp housing 8 having an on-off switch 24 connected therethrough for activation and deactivation of a light source (not shown) inserted into a female adapter, shown as number 12 in FIGS. 2 and 3, that is centrally connected within the concave portion of lamp housing 8 remote from first extension arm 4. In addition, FIG. 1 shows a second bendable extension arm 4 connected to lamp housing 8 and a secondary housing 10 attached to the distal end of second extension arm 4. In the preferred embodiment it is contemplated for the exterior surfaces of lamp housing 8, secondary housing 10, and both extension arms 4 to be made from waterproof materials. Also, although the mechanism used for bending extension arms 4 is not critical, it is contemplated for extension arms 4 to each be bendable over its entire length and configured so that once it is placed into a given orientation, it will remain in that orientation until it is reconfigured into an alternative one. FIG. 1 further shows three activator/disabler switches 14 connected through the bottom surface of secondary housing 10, and a volume control 26 positioned through the back of secondary housing 10 for adjusting the intensity of the signal generated by the audible alarm, shown in FIG. 4 as number 18. The positions of activator/disabler switches 14 and volume control 26 on secondary housing 10 are not critical to the present invention. It is only contemplated that activator/disabler switches 14 and volume control 26 be placed in positions that are easy to reach for convenience of use.

FIG. 2 shows security light device 2 having lamp housing 8 connected to one end of second extension arm 4, secondary housing 10 attached to the distal end of second extension arm 4, and three activator/disabler switches 14 connected through the bottom surface of secondary housing 10. In the preferred embodiment it is contemplated for activator/disabler switches 14 to be electrically connected to objects positioned within the interior of secondary housing 10, shown in more detail in FIG. 4, so that each activator/disabler switch 14 may be selectively used to activate or disable operation of one of the security-related objects positioned within secondary housing 10. FIG. 2 also shows a female light socket adapter 12 centrally located within lamp housing 8 into which a light source (not shown) can be electrically connected.

FIG. 3 shows security light device 2 having bendable first extension arm 4, lamp housing 8 connected to one end of first extension arm 4, and the other end of the first extension arm 4 having male adapter 6 for insertion into the standard type of light socket commonly used in commercial and residential construction. FIG. 3 also shows lamp housing 8 having an on-off switch 24 connected therethrough, bendable second extension arm 4 connected on one of its ends to lamp housing 8, and secondary housing 10 attached to the other end of second extension arm 4. The positioning of on-off switch 24 on lamp housing 8 is not critical to the present invention. The materials from which lamp housing 8, secondary housing 10, and both extension arms 4 are made are also not critical to the present invention, as long as the outer covering over extension arms 4 is made from a flexible or expandable material, such materials are waterproof, and such materials are sufficiently light in weight so that the present invention is easy to handle and use. FIG. 3 also shows female light socket adapter 12 centrally located within lamp housing 8.

Figure 4:
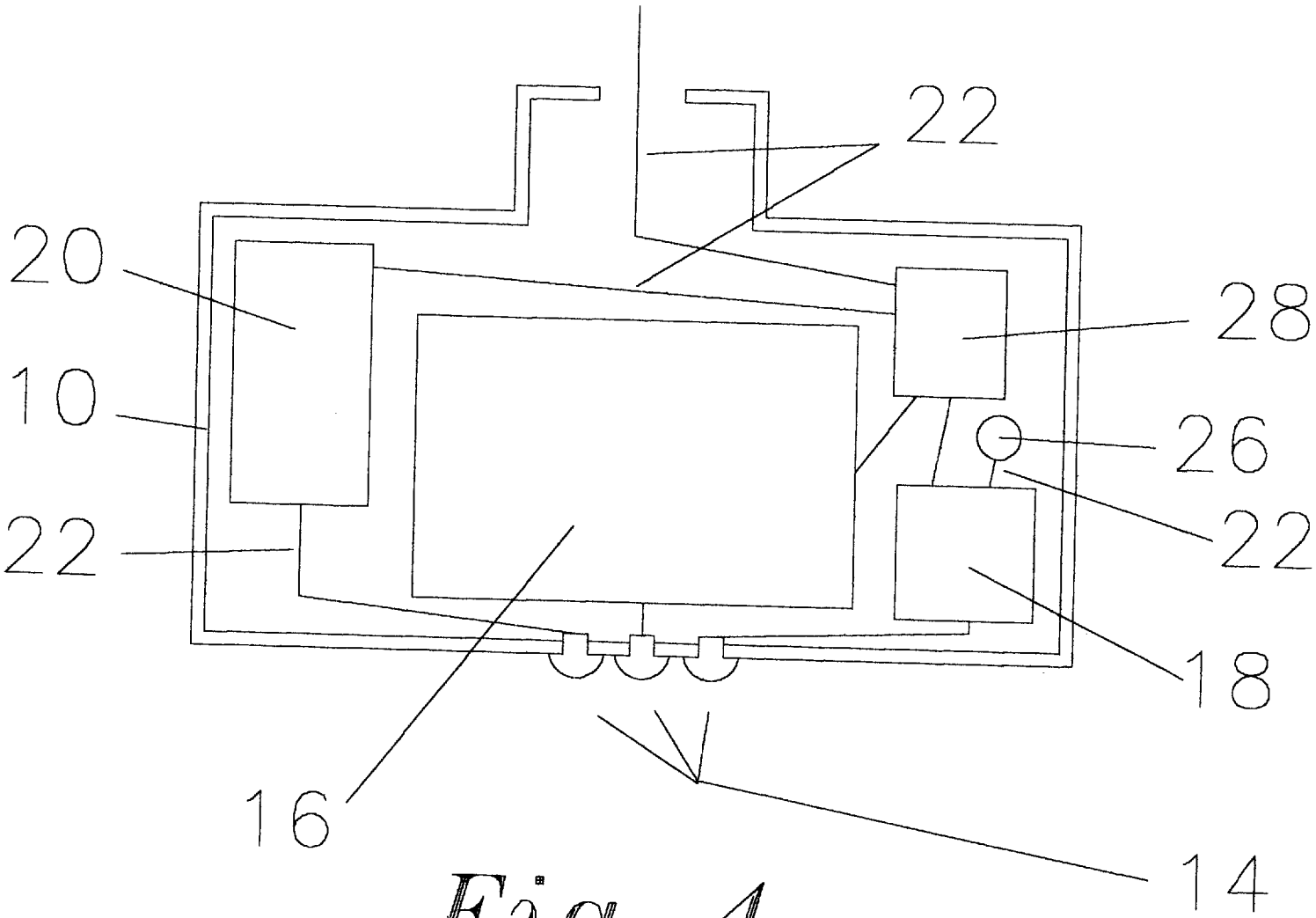
FIG. 4 is a sectional view of the secondary housing of the invention having a control unit therein, as well as a motion detecting sensor, an audible alarm, a light sensor, and electrical wiring for connecting the motion detecting sensor, the audible alarm, and the light sensor each between an activator/disabler switch and the control unit.

FIG. 4 shows a motion detector 16, an audible alarm 18, and a light sensor 20 positioned within secondary housing 10. The actual positions of motion detector 16, audible alarm 18, and light sensor 20 within secondary housing 10 are not critical, although neither audible alarm 18 nor light sensor 20 can be positioned so as to interfere with the optimal operation of motion detector 16. FIG. 4 also shows activator/disabler switches 14 centrally positioned through the bottom surface of secondary housing 10, electrical wiring 22 connecting one activator/disabler switch 14 each to motion detector 16, audible alarm 18, and light sensor 20, and volume control 26 positioned through secondary housing 10 with electrical wiring 22 connecting volume control 26 to audible alarm 18. FIG. 4 further shows additional electrical wiring 22 with one end connected to either motion detector 16, audible alarm 18, or light sensor 20, and its other end connected to a control unit 28, as well as electrical wiring extending from control unit 28 through the upper central portion of secondary housing 10 for connection to male adapter 6, or a remote power source (not shown). Although not critical, in the preferred embodiment it is contemplated for control unit 28 to comprise a microprocessor chip for coordinating the signals from the actuator/disabler switches 14 and volume control 26.

In the preferred embodiment, it is contemplated for two extension arms 4 and one secondary housing 10 to be used and for each extension arm 4 to range between approximately eight inches and twelve inches in length. However, it is within the contemplation of the present invention to have extension arms with other length dimensions, and for more than one secondary housing 10 to be connected to lamp housing 8 so that movement can be monitored in two opposed directions at once from a lighting fixture having a single light socket. Also, in the preferred embodiment, the size of the secondary housing 10 is not critical. However, secondary housing 10 should not be so large that it unnecessarily adds weight to security light device 2 and thereby makes it cumbersome to handle and use. Also, in the preferred embodiment of the present invention the means of connection (not shown) between second extension arm 4 and lamp housing 8 is not critical as long as it permits a removable electrical connection therebetween. Should second extension arm 4 be removed from its point of connection to lamp housing 8 and not replaced, although not shown, it is contemplated for a fire-rated cap made of waterproof material to be placed over the connection point. Also, although not critical, the detachable means of connecting second extension arm 4 to lamp housing 8 should be a means that is fast and convenient to use, such as a screw-type of threaded attachment means. Also, the configuration and dimension of audible alarm 18, light sensor 20, and motion detector 16, are not critical to the present invention as long as each is sized for placement within secondary housing 10 and so that the size and shape of each does not interfere with the operation of the others. The configuration and dimension of volume control 26 for controlling the intensity of the signal produced by audible alarm 18 are also not critical to the present invention.

To use the preferred embodiment of the present invention to provide security lighting in or around a building (not shown), one would securely connect the end of first extension arm 4 having male adapter 6 into an existing light fixture socket (not shown) attached to a building wall or otherwise electrically connect first extension arm 4 to a remote power source (not shown) within the building. The operator (not shown) would then place a light source (not shown) sufficiently within female adapter 12 to achieve good electrical connection between the light source and female adapter 12. Assuming that motion detector 16, light sensor 20, and audible alarm 18 are all required for the desired use, the operator would remove the cap (not shown) used to cover at least one connection point on lamp housing 8 for second extension arms 4 in their absence, and connect at least one second extension arm 4 to lamp housing 8. On-off switch 24, volume control 26, and activator/disabler switches 14 would be engaged to select the desired combination of features for use, to include a spotlight lamp (not shown), motion detector 16, light sensor 20, and audible alarm 18. Each extension arm would then be bent and twisted by the operator into a desired orientation to provide optimal lighting coverage for a targeted area. Once placed into the given orientation, each extension arm 4 would remain in that orientation until it is again reconfigured. Should a gutter down spout be in the way of optimal coverage, extension arm 4 would be reoriented to position lamp housing 8 or secondary housing 10 so that interference from the gutter down spout is avoided. Also, when complex roof lines make installation of prior art lighting fixtures inconvenient or inadequate to obtain optimal lighting coverage around a building, the present invention will give the operator increased flexibility during installation by allowing the installer to connect male adapter 6 on one side of a building and permit the installer to bend extension arms 4 so that lamp housing 8 and/or secondary housing 10 can be positioned around a corner for use in targeting areas on a different side of the building. Once placed into a given orientation, extension arms 4 are configured to retain their given orientation until they are placed into a new one. Since it is contemplated for the materials used to make the outer surfaces of lamp housing 8, secondary housing 10, and extension arms 4 to be waterproof, the present invention could be employed for either external or internal building use.

What is claimed is:

1. A lighting extension device comprising a lamp housing; a plurality of elongated extension arms each having opposite ends, each of said extension arms being bendable along its entire length into an unlimited number of orientations and being able to remain in a given orientation until reconfigured into a new orientation, one of said opposite ends of a first one of said extension arms being connected to said lamp housing; electrical connection means for connecting said device to a remote power source being connected to the other of said opposite ends of said first extension arm; and lighting control means electrically connected to said light housing through at least one other of said extension arms.

2. The device of claim 1 wherein said electrical connection means comprises a male adapter configured and sized for connection to the type of light socket commonly used in commercial and residential construction for external lighting purposes.

3. The device of claim 1 wherein said lighting control means comprises a secondary housing, a motion detector positioned within said secondary housing, and sufficient electrical wiring to connect said motion detector to said lamp housing for automatic engagement of a light source secured within said lamp housing in response to movement detected by said motion detector within a predetermined target area.

4. The device of claim 3 wherein said lighting control means further comprises a light sensor positioned within said secondary housing, and sufficient electrical wiring to connect said light sensor to said lamp housing for engagement of a light source secured within said lamp housing in response to movement detected by said motion detector within a predetermined target area during daylight hours.

5. The device of claim 4 further comprising an audible alarm positioned within said secondary housing, and sufficient electrical wiring to connect said audible alarm to said lamp housing for possible concurrent engagement of both a light source secured within said lamp housing and said audible alarm in response to movement detected by said motion detector within a predetermined target area.

6. The device of claim 5 further comprising a plurality of activator/disabler switches, one of said switches being connected to said audible alarm, one of said switches being connected to said light sensor, and one of said switches being connected to said motion detector.

7. The device of claim 6 further comprising an on-off switch electrically connected to said lamp housing for selective operation of a light source secured therein.

8. The device of claim 7 further comprising a volume control electrically connected to said audible alarm for selective modification of the intensity of the signal produced by said audible alarm.

9. The device of claim 8 wherein said electrical connection means comprises a male adapter configured and sized for connection to the type of light socket commonly used in commercial and residential construction for external lighting purposes.

* * * * *